US007740215B2

(12) United States Patent
Lang

(10) Patent No.: US 7,740,215 B2
(45) Date of Patent: Jun. 22, 2010

(54) JERSEY DISPLAY DEVICE

(76) Inventor: Darin Lang, 14 Furness Bay, Winnipeg, Mb (CA) R2N 2S4

( * ) Notice: Subject to any disclaimer, the term of this patent is extended or adjusted under 35 U.S.C. 154(b) by 42 days.

(21) Appl. No.: 12/132,718

(22) Filed: Jun. 4, 2008

(65) Prior Publication Data

US 2008/0296450 A1 Dec. 4, 2008

Related U.S. Application Data

(60) Provisional application No. 60/941,726, filed on Jun. 4, 2007.

(51) Int. Cl.
*A47G 1/17* (2006.01)

(52) U.S. Cl. ..... 248/206.5

(58) Field of Classification Search ..... 248/206.5, 248/447.1, 467, 205.1
See application file for complete search history.

(56) References Cited

U.S. PATENT DOCUMENTS

| | | | | |
|---|---|---|---|---|
| 2,641,793 | A | 6/1953 | Wilm | |
| 2,967,038 | A | 1/1961 | Lennemann | |
| 4,605,292 | A * | 8/1986 | McIntosh | 359/870 |
| 4,678,150 | A * | 7/1987 | Newman et al. | 248/205.3 |
| 4,875,654 | A * | 10/1989 | Chandonnet et al. | 248/467 |
| 5,039,047 | A | 8/1991 | Pitzo | |
| 5,125,134 | A * | 6/1992 | Morita | 24/303 |
| 5,895,018 | A * | 4/1999 | Rielo | 248/206.5 |
| 6,260,749 | B1 | 7/2001 | Horovitz | |
| 6,305,656 | B1 * | 10/2001 | Wemyss | 248/309.4 |
| 2006/0192062 | A1 * | 8/2006 | Tunze | 248/206.5 |
| 2008/0210835 | A1 * | 9/2008 | Bagnall | 248/206.5 |

* cited by examiner

*Primary Examiner*—J. Allen Shriver, II
*Assistant Examiner*—Erin Smith
(74) *Attorney, Agent, or Firm*—Ade & Company Inc.; Ryan W. Dupuis; Kyle R. Satterthwaite

(57) ABSTRACT

A jersey display device permits a jersey to be displayed on an upright supporting surface, for example a wall, in two different orientations in which the two opposing sides of the jersey are displayed respectively. The device comprises: a panel having a contour which is suitably shaped so as to be arranged for supporting the jersey thereon, a first coupling member supported on the panel to be concealed by the jersey, and a second coupling member arranged to be supported on the wall mount. The first and second coupling members are magnetically attracted to one another so as to be arranged to support the panel with the jersey supported thereon on the wall.

19 Claims, 5 Drawing Sheets

JERSEY DISPLAY DEVICE

This application claims the benefit under 35 U.S.C. 119(e) of U.S. provisional application Ser. No. 60/941,726, filed Jun. 4, 2007.

FIELD OF THE INVENTION

The present invention relates to a device for displaying a jersey and more particularly relates to a device for supporting and displaying either the front or the back of a jersey on an upright supporting surface, for example a wall, using magnets so that the jersey appears to be floating as there is no visible means of support. Changing the display of the jersey to front or back requires no reassembly of the device.

BACKGROUND

Sports jerseys from many sports are a common collectible. Often these jerseys are valuable and accordingly it is desired to display them, hanging on a wall for example.

U.S. Pat. No. 2,967,038 belonging to Lennemann, U.S. Pat. No. 2,641,793 belonging to Wilm, U.S. Pat. No. 4,678,150 belonging to Newman et al., U.S. Pat. No. 5,125,134 belonging to Morita, U.S. Pat. No. 5,039,047 belonging to Pitzo and U.S. Pat. No. 6,260,749 belonging to Horovitz disclose various examples of devices using magnetic forces for supporting an object on an upright supporting surface. None are well suited for interchangeably supporting a jersey in a form fitting panel and mount thereon however so as not to harm the jersey or mounting surface while also permitting the jersey to be reversible to display either side thereof.

SUMMARY OF THE INVENTION

According to one aspect of the invention there is provided a jersey display device for displaying a jersey, the device comprising:

a panel having a contour which is suitably shaped so as to be arranged for supporting the jersey thereon;

a first coupling supported on the panel such that the first coupling member is arranged to be concealed by the jersey supported on the panel;

a wall mount arranged to be secured to an upright supporting surface;

a second coupling member supported on the wall mount;

the first and second coupling members being arranged to be magnetically attracted to one another so as to be arranged to support the panel with the jersey supported thereon on the upright supporting surface.

By providing first and second coupling members which are magnetically attracted to one another, the panel which is arranged to support a jersey thereon, can be supported on any upright surface in any orientation while remaining readily removable for interchanging the jersey as desired, or for personal use. By providing a panel suitably shaped to hang a jersey thereon and locating the first coupling member on the panel so as to be arranged to be concealed by the jersey, the panel is well suited for supporting the jersey in a reversible manner while also permitting the jersey to be readily interchanged with another jersey without damage to the jersey. In addition, the entire display can be easily moved from one surface to another without damaging the mounting surface and no reassembly is required for the jersey panel.

All components of the panel, the wall mount and the coupling members are preferably concealed by the jersey supported on the panel when the panel is supported on an upright supporting surface such that the jersey has the generally appearance of floating on the upright supporting surface.

Preferably the coupling members are arranged to reversibly support the panel on the upright supporting surface such that the panel is arranged to be magnetically supporting by the coupling members in a first configuration in which a first side of the panel (and a first side of the jersey supported thereon) faces the wall mount and a second configuration in which a second side of the panel (and a second side of the jersey supported thereon) faces the wall mount.

Preferably both the first and second coupling members comprise magnets which are suitably oriented to be magnetically attracted to one another.

The first coupling member may be nearer to a top edge of the panel than a bottom edge of the panel so that the first coupling member is arranged to be supported above a center of gravity of the panel when a jersey is mounted thereon.

Preferably at least one of the first coupling or the second coupling member comprises a pair of spaced apart magnets oriented with opposing polarities facing outwardly relative to one another.

When the first coupling member comprises two spaced apart magnets, preferably both of the magnets are positioned nearer to a top of the panel than a bottom of the panel so that both of the magnets are positioned above a center of gravity of the panel.

Preferably the first coupling member is laterally centered on the panel.

The first coupling member may be received within a mating recess in the panel for flush mounting within the panel.

The first coupling member is preferably retained on the panel by a suitable adhesive sheet.

The panel may be arranged to span substantially a full height and a full width of the jersey and may further have a contour which mates with a contour of the jersey when the jersey is laid flat.

When provided in combination with a basketball jersey, the panel preferably comprises a single integral panel spanning a full height and a full width of the jersey.

When provided in combination with a football jersey or a hockey jersey, the panel preferably comprises two separate and substantially identical equal portions arranged to be joined along a vertical seam. The assembled panel in this instance has the same contour and similar height and width characteristics as the jersey.

When provided in combination with a baseball jersey having a buttoned seam along a front side thereof, the panel preferably comprises a single integral piece spanning a full height and a full width of the jersey.

The wall mount may be arranged to be secured to the upright supporting surface using adhesive.

In another embodiment, the wall mount may be arranged to be secured to the upright supporting surface using a fastener and the second coupling member is arranged to be secured to the wall mount using adhesive.

Preferably the coupling members are arranged to reversibly support the panel on the upright supporting surface such that the panel is arranged to be magnetically supporting by the coupling members in a first configuration in which a first side of the panel faces the wall mount and a second configuration in which a second side of the panel faces the wall mount.

When in combination with a jersey supported on an upright supporting surface by the coupling members, preferably all components of the panel, the wall mount and the coupling members are concealed by the jersey.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 2:
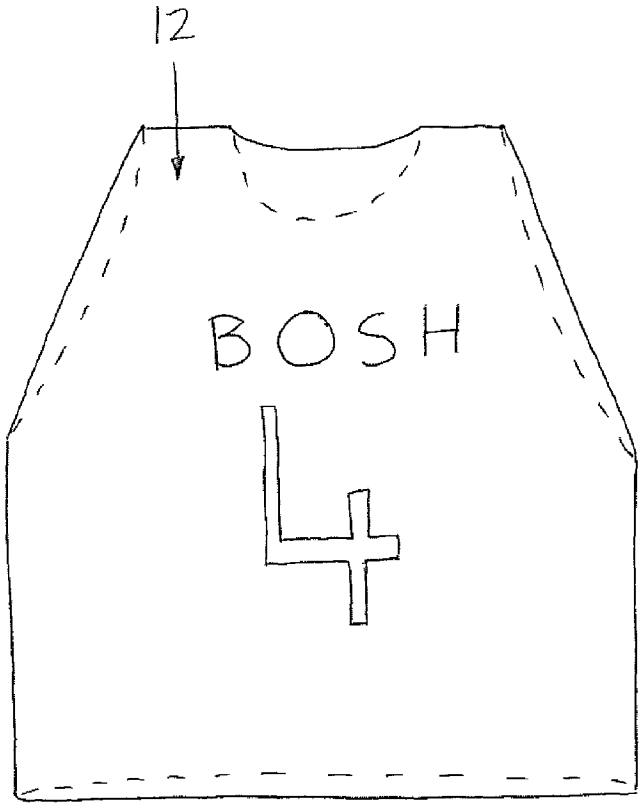
FIG. 2 is a rear view of the sports jersey of FIG. 1.
Figure 1:
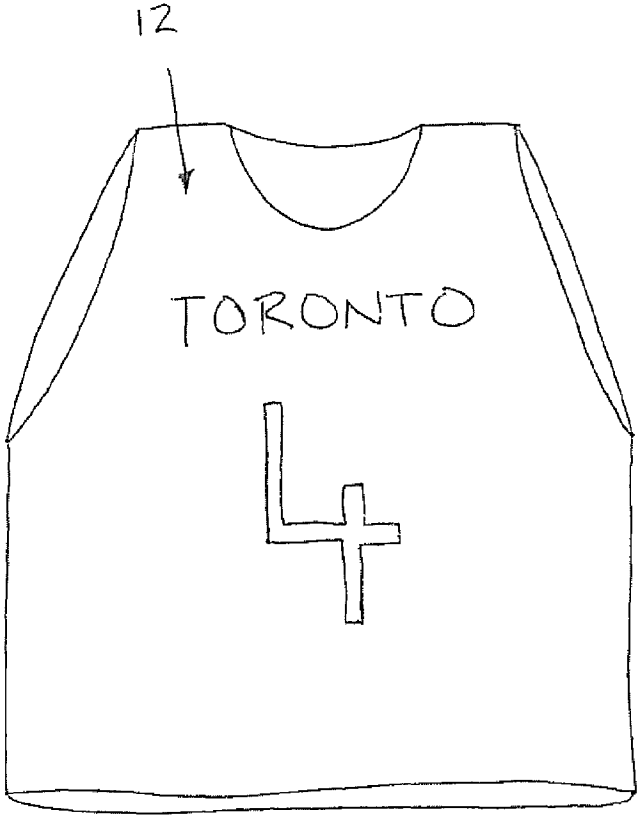
FIG. 1 is front view of an exemplary sports jersey.
Figure 4:
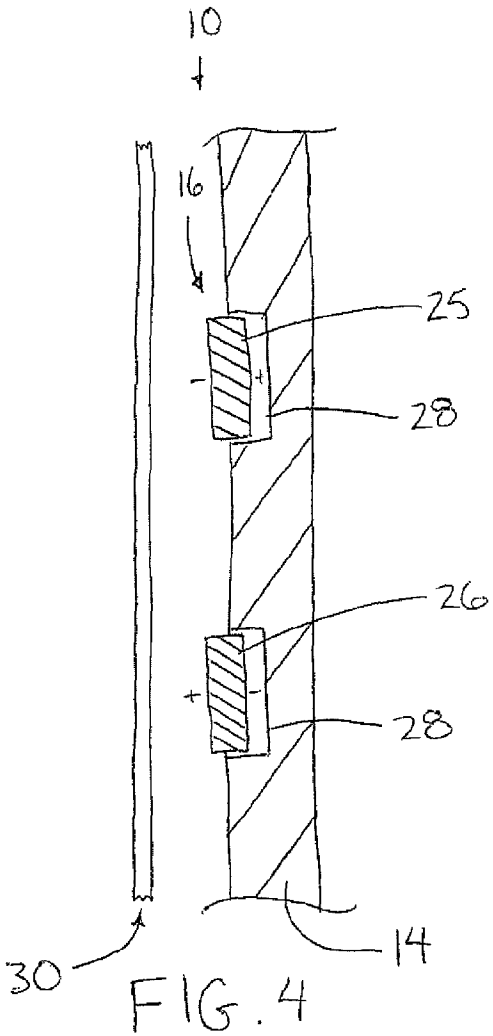
FIG. 4 is a sectional view along the line 4-4 in FIG. 3.
Figure 3:
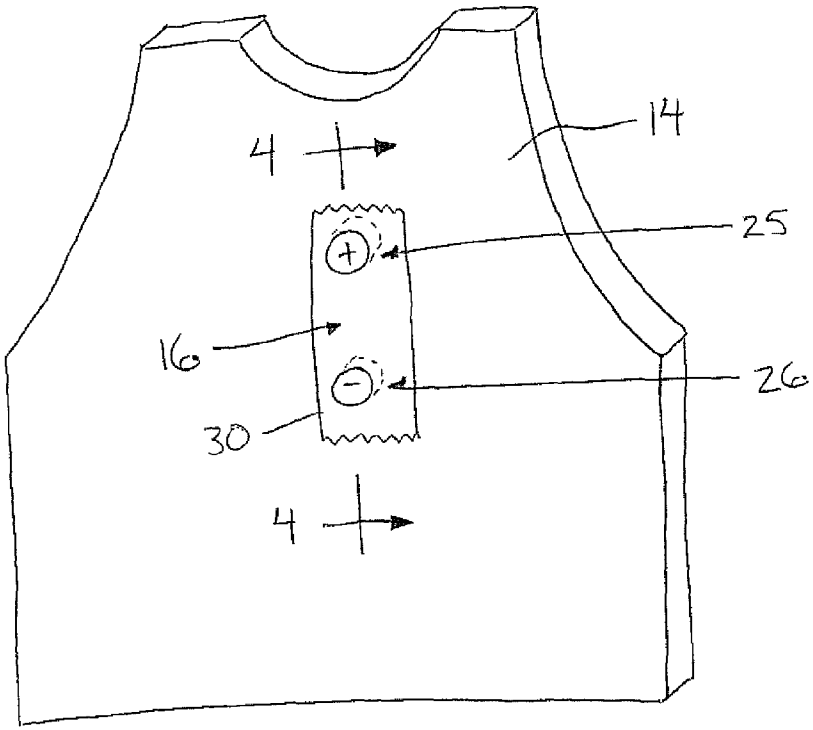
FIG. 3 is an illustration of the configuration of the panel for use with the jersey according to FIG. 1.

Referring to the accompanying figures there is illustrated a jersey display device generally indicated by reference numeral 10. The device 10 is particularly suited for supporting a sports jersey 12 thereon, for example a basketball, baseball or football jersey and the like.

The device 10 includes a panel 14 which is cut from a rigid foam board material to have a suitable contour that matches the contour of the jersey when the jersey is laid flat. In the first illustrated embodiment, the panel 14 is cut to match the shape of a basketball jersey with the panel comprising a single integral piece which spans a full height and a full width of the jersey. The panel 14 can then be inserted into the jersey so that the front and back sides of the jersey extend over both front and back sides of the panel respectively.

The panel is arranged to be coupled to an upright supporting surface, for example a building wall 11, by a first coupling member 16 supported on the panel and a second coupling member 18 to be supported on the wall, in which the coupling members are magnetically attracted to one another using rare earth magnets.

The second coupling member 18 is arranged to be supported on the building wall 11 by a wall mount 20 which comprises a layer of suitable adhesive tape 22 in the illustrated embodiment. A double sided tape, for example a removable and non-marking type available under the 3M™ brand is suitable.

In alternative embodiments, the wall mount 20 may be fastened to the wall 11 by a suitable mounting plate which is screwed or otherwise fastened to the wall. In either instance adhesive is used to secure a rare earth magnet 23 either directly to the wall by adhesive or to the screw mounting plate by adhesive such that a first positive polarity side of the magnet faces outwardly in the illustrated embodiment.

Figure 6:
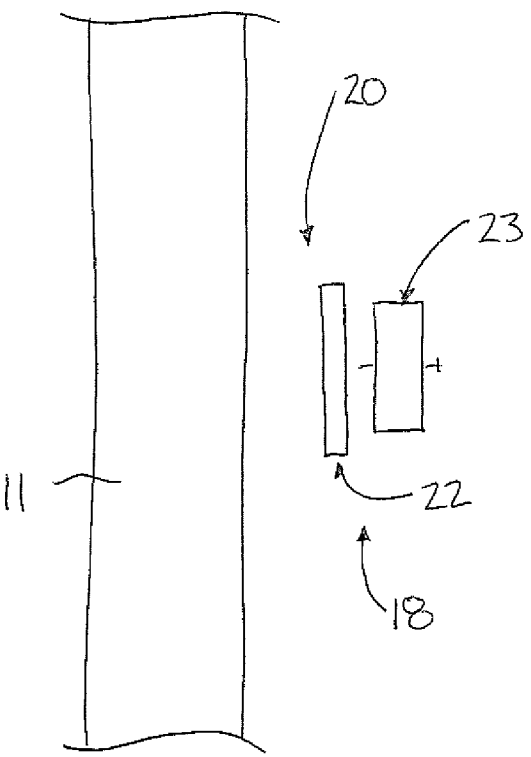
FIG. 6 is a partly sectional elevational view of a second embodiment of the wall mount.
Figure 5:
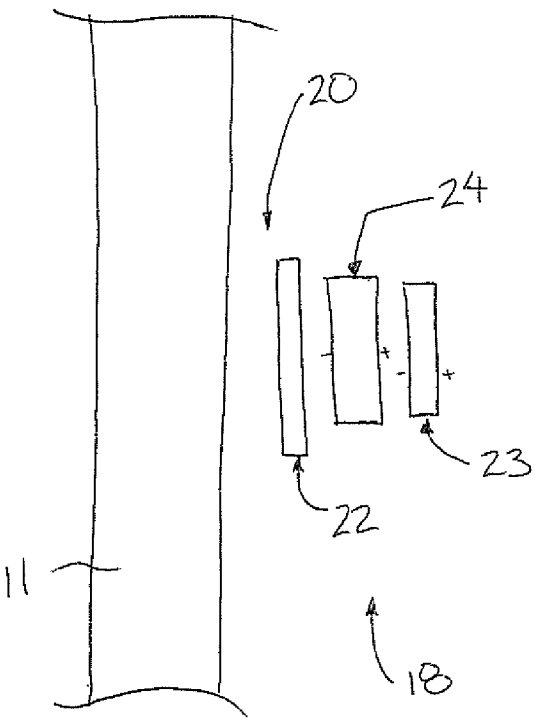
FIG. 5 is a partly sectional elevational view of a first embodiment of the wall mount.
Figure 8:
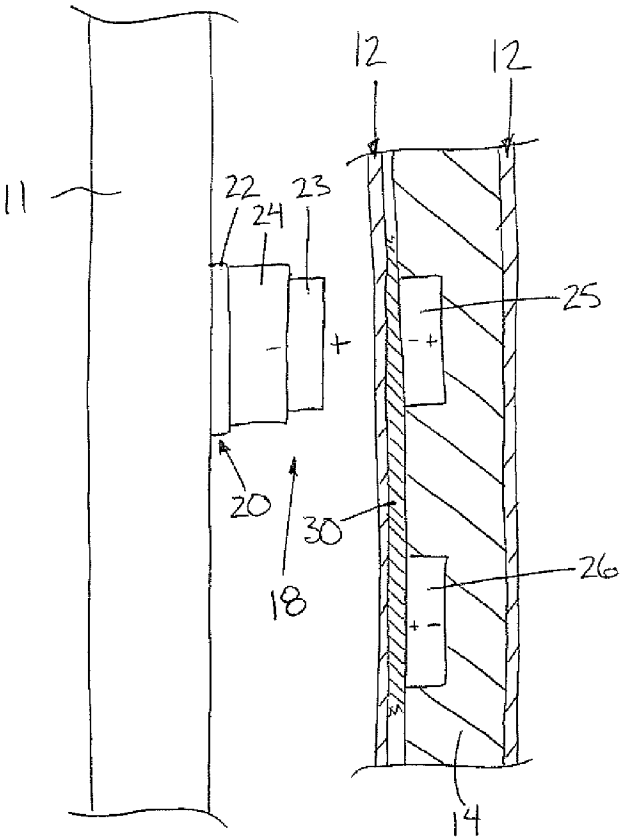
FIG. 8 is a sectional elevational view of the panel including a jersey supported thereon for interaction with the wall mount in a second mounted position.

In the embodiment of FIG. 6, the magnet 23 is secured directly to the wall by adhesive, however in the alternative embodiment of FIG. 5, an auxiliary coupling unit 24 may be provided which is coupled between the magnet 23 and the adhesive or wall mount to enhance the magnetic attraction of the magnet 23.

The auxiliary coupling is supported on the wall for 2 reasons: 1) to provide added support, i.e., a larger magnetic surface, and 2) for appearance so that the jersey is not flush with the wall. Therefore the entire display is raised from the wall for improved aesthetic purposes and appears to be floating.

The first coupling member 16 is arranged to be embedded in the panel and comprises an uppermost first magnet 25 and a lowermost second magnet 26. The two magnets are laterally centered relative to the panel and are vertically spaced relative to one another in the order of four inches for example to avoid magnetic interaction between the two magnets. The first and second magnets of the first coupling member 16 are both positioned to be nearer to the top of the panel than the bottom of the panel so as to be both individually located above a center of gravity of the panel when a jersey is supported thereon.

The two magnets are mounted to the panel by being received in respective recesses 28 formed in the panel in one side thereof so as to be aligned with the respective magnet mounting locations. The two recesses 28 are the same size and depth as the magnets to closely fit the magnets therein to be flush mounted with the surface of the panel. The first and second magnets 25 and 26 are mounted so that opposing polarities face outwardly, that is the uppermost of the two magnets is oriented with a first or positive polarity side facing outwardly while the lowermost magnet has a second or negative sided polarity facing outwardly. Tape 30 or some other adhesive sheet of suitable configuration lays overtop of the magnets received in the respective recesses 28 to retain the magnets therein.

The foam board forming the panel is in the order of half an inch in thickness in the illustrated embodiment. The magnets have a thickness typically near one quarter of an inch to be received in recesses which are of similar depth so that the magnets are located directly adjacent to one face of the panel. The magnets are resultingly near a quarter of an inch away from the opposing face of the panel so as to have sufficient magnetic attraction through either face of the panel even when a jersey is supported thereon for magnetic attraction with the second coupling member on the wall mount to suspend the panel from either one of the two magnets of the first coupling member.

Figure 7:
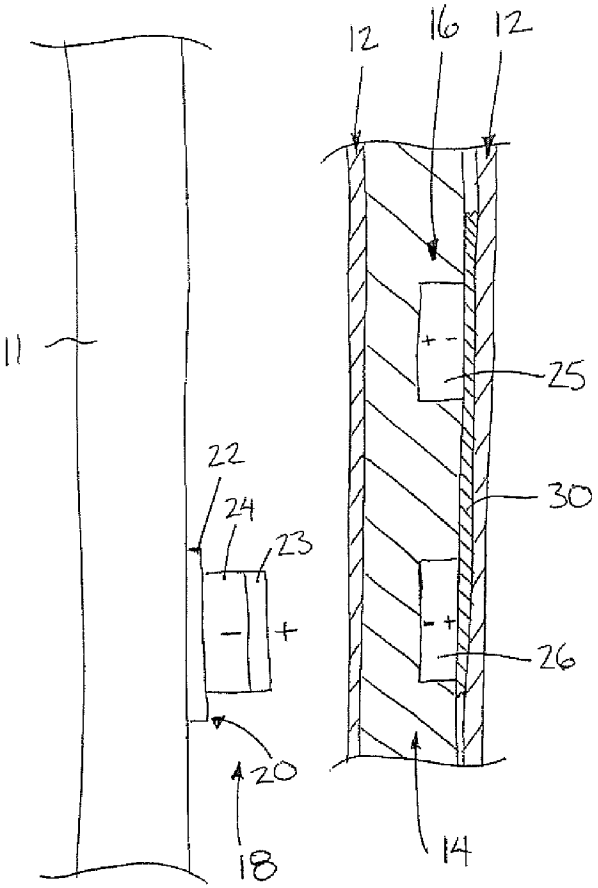
FIG. 7 is a sectional elevational view of the panel including a jersey supported thereon for interaction with the wall mount in a first mounted position.

As shown in FIG. 7 in a first mounting position, the jersey is shown mounted overtop of the panel with the magnets being arranged such that the lowermost magnet of the first coupling member is aligned with the magnet of the second coupling member. By aligning the second negative polarity side of the lowermost one of the magnets to face the magnet on the wall mount, the coupling members are attracted to one another with sufficient strength to fully suspend the panel with a jersey mounted thereon on the wall. When it is desired to display the opposing side of the jersey, simply pulling the panel and jersey mounted thereon away from the wall and flipping it over so that the opposing rear side of the jersey faces outwardly from the wall instead, allows the other magnet to be attracted to the wall mount. This occurs because the other one of the magnets of the first coupling member then includes a second negative polarity side facing the wall for magnetic alignment and interaction with the magnet on the wall mount to again fully support the weight of the panel and jersey thereon on the wall. The panel is thus arranged to be reversibly mounted in two positions in which opposing sides of the panel lie against the supporting surface in the two positions respectively.

Figure 9:
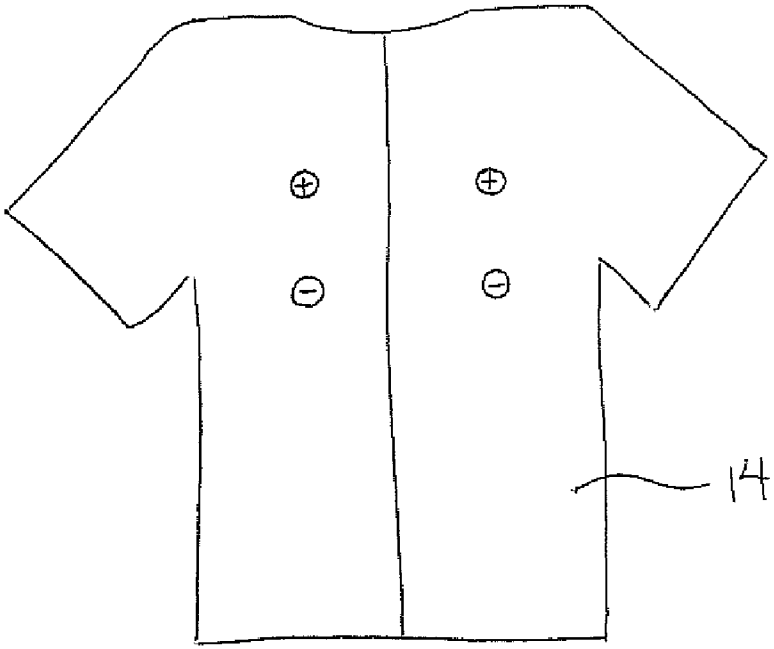
FIG. 9 is a schematic illustration of an alternative embodiment of the panel.

As shown in FIG. 9, in other embodiments the panel may comprise a two piece panel which is separated by a vertical seam with suitable coupling at the seam by tape for example once the two pieces of the panel are inserted into the jersey. This two piece configuration is particularly suited for a jersey arranged similarly to a football jersey in which the jersey is of unitary construction with sleeves. When a central seam is located in the panel, the magnets of the first coupling member may be provided in pairs laterally spaced apart at equal distance from the seam on opposing sides of the seam. For sleeved jerseys, for example baseball, hockey and football jerseys, 4 magnets are recommended in the panel and 2 coupling members on the wall, due to the weight of the jerseys. For sleeveless jerseys, for example basketball, only 2 magnets are recommended in the panel, and one coupling member on the wall.

In further embodiments where the jersey is arranged to be buttoned up, for example like a typical baseball jersey, the panel can remain as a single integral piece even when sleeves are provided.

In order to use the device as described herein, the wall area where the jersey display device is arranged to be supported is first cleaned so that the wall mount can be secured with adhesive thereto. Once the jersey is mounted onto the panel, the first coupling member is aligned with the second coupling member in the wall mount so that the magnetic attraction therebetween is sufficient to hold the jersey onto the wall. Simply sliding the jersey assembly in any direction is sufficient to release the magnetic attraction between the first coupling member in the jersey assembly and the second coupling member on the wall to permit the jersey assembly to be readily removed from the wall. When it is desired to display the opposing side of the jersey, the panel is simply reversed with the jersey thereon and a different one of the magnets of the first coupling member is aligned with the magnetic on the wall mount.

As described herein the panel is preferably formed of a foam board material, which may be a forty inch by twenty inch foam board of half inch thickness which is then cut by the user to the desired pattern of the jersey. Suitable magnets are found to be heavy duty, rare earth magnets near one inch or ¾ of an inch in diameter and generally in the range of ¼ to ⅛ of an inch in thickness. Packing tape or any other suitable adhesive applied sheet would be suitable for retaining the magnets within the recesses in the foam board. The adhesive for securing the wall mount to the wall may comprise any variety of commercially available adhesives, however one inch by one inch sticky squares which are arranged to be removable and are available from 3M brand are found to be particularly suitable.

In further embodiments, the polarities of the magnets can be reversed relative to the exemplary embodiment described herein, while still obtaining the benefits of the present invention. Furthermore, the number of coupling members or magnets can be varied to accommodate different weights. In yet further embodiments some of the coupling members may comprise ferromagnetic members while others comprise magnets so that the coupling members are still magnetically attracted to one another without all coupling members comprising magnets.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A jersey display device for displaying a jersey, the device comprising:

a panel having a contour which is suitably shaped so as to be arranged for supporting the jersey thereon;

a first coupling member supported on the panel such that the first coupling member is arranged to be concealed by the jersey supported on the panel;

a wall mount arranged to be secured to an upright supporting surface;

a second coupling member supported on the wall mount;

the first coupling member on the panel and the coupling member on the wall surface being arranged to be magnetically attracted to one another so as to be arranged to support the panel with the jersey supported thereon on the upright supporting surface.

2. The device according to claim 1 wherein both the first and second coupling members comprise magnets which are suitably oriented to be magnetically attracted to one another.

3. The device according to claim 1 wherein the first coupling member is nearer to a top edge of the panel than a bottom edge of the panel.

4. The device according to claim 1 wherein the first coupling member is arranged to be supported above a center of gravity of the panel when a jersey is mounted thereon.

5. The device according to claim 1 wherein at least one of the first coupling or the second coupling member comprises a pair of spaced apart magnets oriented with opposing polarities facing outwardly relative to one another.

6. The device according to claim 5 wherein the first coupling member comprises two spaced apart magnets and wherein both of the magnets are positioned nearer to a top of the panel than a bottom of the panel.

7. The device according to claim 5 wherein the first coupling member comprises two magnets and wherein both of the magnets are positioned above a center of gravity of the panel.

8. The device according to claim 1 wherein the first coupling member is laterally centered on the panel.

9. The device according to claim 1 wherein the first coupling member is received within a mating recess in the panel for flush mounting within the panel.

10. The device according to claim 1 wherein the first coupling member is retained on the panel by a suitable adhesive sheet.

11. The device according to claim 1 wherein the panel is arranged to span substantially a full height and a full width of the jersey and has a contour which mates with a contour of the jersey when the jersey is laid flat.

12. The device according to claim 1 in combination with a basketball jersey, wherein the panel comprises a single integral panel spanning a full height and a full width of the jersey.

13. The device according to claim 1 in combination with a football jersey wherein the panel comprises two separate and substantially identical equal portions arranged to be joined along a vertical seam.

14. The device according to claim 1 in combination with a hockey jersey wherein the panel comprises two separate and substantially identical equal portions arranged to be joined along a vertical seam.

15. The device according to claim 1 in combination with a baseball jersey wherein the panel comprises a single integral piece spanning a full height and a full width of the jersey.

16. The device according to claim 1 wherein the wall mount is arranged to be secured to the upright supporting surface using adhesive.

17. The device according to claim 1 wherein the wall mount is arranged to be secured to the upright supporting surface using a fastener and the second coupling member is arranged to be secured to the wall mount using adhesive.

18. The device according to claim 1 wherein the coupling members are arranged to reversibly support the panel on the upright supporting surface such that the panel is arranged to be magnetically supporting by the coupling members in a first configuration in which a first side of the panel faces the wall mount and a second configuration in which a second side of the panel faces the wall mount.

19. The device according to claim 1 in combination with a jersey supported on an upright supporting surface by the coupling members wherein all components of the panel, the wall mount and the coupling members are concealed by the jersey.

* * * * *